United States Patent [19]

Lassiter

[11] Patent Number: 4,723,324

[45] Date of Patent: Feb. 9, 1988

[54] COLD WEATHER GLOVE SYSTEM WITH TACTILE IMPROVEMENT

[75] Inventor: B. Dean Lassiter, Greensboro, N.C.

[73] Assignee: Burlington Industries, Inc., Greensboro, N.C.

[21] Appl. No.: 918,920

[22] Filed: Oct. 15, 1986

[51] Int. Cl.[4] ..... A41D 19/00

[52] U.S. Cl. ..... 2/160; 2/161 R; 2/163

[58] Field of Search ..... 2/163, 159, 160, 161 R

[56] References Cited

U.S. PATENT DOCUMENTS

| | | | |
|---|---|---|---|
| 380,079 | 3/1888 | Biggin | 2/163 |
| 527,704 | 10/1894 | Merrill | 2/163 |
| 745,088 | 11/1903 | Winkler | 2/163 |
| 1,066,480 | 7/1913 | Finlay | 2/163 X |
| 1,243,622 | 10/1917 | Nielsen | 2/161 R |
| 1,250,150 | 12/1917 | DuBois | 2/158 |
| 1,911,500 | 5/1933 | Gowdy et al. | 2/163 X |
| 2,702,906 | 3/1955 | Causse | 2/159 |
| 2,736,034 | 2/1956 | Fredenhagen et al. | 2/163 X |
| 3,096,523 | 7/1963 | Bruchas | 2/159 |
| 3,098,237 | 7/1963 | Slimovitz | 2/164 |
| 4,021,640 | 5/1977 | Gross et al. | 2/161 R |
| 4,507,807 | 4/1985 | Karkanen | 2/161 R |

*Primary Examiner*—Louis K. Rimrodt

*Attorney, Agent, or Firm*—Nixon & Vanderhye

[57] ABSTRACT

A thermal and/or protective glove construction is disclosed which increases tactile sensitivity. In each of the thumb and fingertip portions of the glove there is provided a finger contact pad and a relatively stiff transmission system for transmitting detected vibrations from external stimuli to the wearer's fingertips. The finger contact pads may be Velcro TM fastener material and the transmission system may comprise a plurality of rigid plastic prongs embedded in the relatively thick insulating material used in thermal gloves. Additional response surface pads, which also may be of Velcro TM fastener material, may be applied to the external side of the transmission material.

30 Claims, 8 Drawing Figures

COLD WEATHER GLOVE SYSTEM WITH TACTILE IMPROVEMENT

BACKGROUND OF THE INVENTION

Gloves or mittens utilized for cold weather protection depend on bulk to obtain good thermal comfort. As bulk or thickness is increased, however, the user's ability to detect, for example, vibrations from external stimuli, is diminished. A similar problem exists with respect to work gloves used to protect one's hands and fingers from injury. The relatively thick and tough material often utilized in the construction of work gloves also results in a loss of tactile sensitivity.

This invention seeks to provide a glove system which retains good thermal and protective characteristics, but which nevertheless provides increased tactile sensitivity in the fingertip portions of the glove.

Prior attempts at solving the problem of providing increased sensitivity in relatively thick gloves have not been completely satisfactory. In U.S. Pat. No. 4,507,-807, for example, a work glove is disclosed wherein the tips of one or more fingers of the glove are made of relatively thin, pliable material, without fingertip seams, to increase sensitivity. In U.S. Pat. No. 3,098,237, a thermal glove is disclosed in which increased sensitivity is obtained by the provision of slits disposed in suitable portions of the lining of the glove in such a manner as to selectively permit the passage of the thumb or fingers of a user through these slits and into contact with the interior surface of the outer covering of the glove. While these glove constructions undoubtedly increase tactile sensitivity, they also sacrifice thermal and/or protective characteristics in the process.

In the present invention, a glove and mitt construction is disclosed wherein at least one, and preferably all of the finger and thumb portions of the glove or mitt have structure which increases tactile sensitivity without sacrificing thermal and/or protective characteristics.

In one exemplary embodiment of the invention, the interior tips of the thumb portion and finger portions are provided with individual finger pads, external response surfaces, and transmission systems within the fabric of the glove for transmitting external vibrations received from an external source to the fingertips of the wearer. In the preferred embodiment, a cold weather glove or mitt construction includes an exterior shell, an intermediate insulating layer, and an inner liner. In the interior thumb and fingertip portions of the glove, there are provided discrete finger contact pads constructed of relatively stiff material and located between the inner liner and the insulating layer. These pads may consist of the well known hook and loop fastener material, marketed under the name Velcro TM, on one side, with a suitable adhesive on the other side. Similar pads of material, forming external response surfaces, may be 0 disposed between the intermediate insulating layer and the outer shell in areas directly beneath the finger contact pads provided in the interior of the glove. Sandwiched between each of the finger contact pads and the exterior response surface pads, is a relatively stiff transmission system which serves to transmit vibrations from external sources to the fingertips of the wearer. The transmission system may take on a variety of configurations, so long as the material used therein is stiffer than the intermediate insulating layer. For most applications, it is advantageous to remove a cylindrical plug of insulation material between each of the finger contact pads and the external response surface pads to form, for example, a cylindrical cavity for receiving the material which comprises the transmission system.

In one embodiment, the transmission system comprises stiff plastic prongs embedded in a previously removed plug of insulating material which is reinserted into the same or a similar cavity between the finger contact pads and the external response surface pads. In another embodiment, the transmission system comprises a solid polystyrene plug. In a third embodiment, the transmission system comprises a plurality of polystyrene pellets embedded within a plug of insulating material. In a fourth embodiment, the transmission system comprises one or more of the hook and loop fastening type pads similar to those used as the finger pads and as the external response surface pads. And in a fifth embodiment, the transmission material is a stiff, open cell foam material shaped so as to fit within the cavity formed in the insulating layer.

The combination of relatively stiff materials used for each of the finger pads, transmission systems, and external response surface pads, permits the retention of the bulk necessary for providing good thermal and/or protective characteristics while, at the same time, imparts to the glove a desirable increase in tactile sensitivity.

DETAILED DESCRIPTION OF THE DRAWINGS

Figure 1:
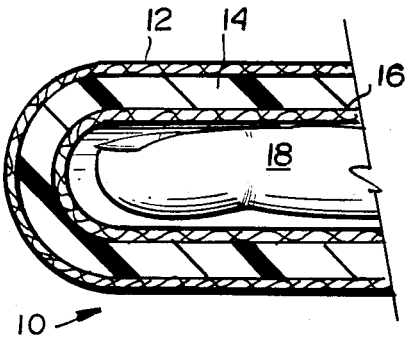
FIG. 1 PRIOR ART
FIG. 1 is a cross-sectional view of a finger portion of a conventional thermal glove construction.

Referring now to FIG. 1, a cold weather, or thermal, glove 10 is shown in partial cross-section to illustrate the layered construction of known gloves of this type. The glove includes a shell layer 12, a relatively thick insulating layer 14 and an inner lining 16. There is also shown a wearer's finger 18 inserted within a finger portion of the glove. In one known prior art construction, the relatively thick insulating layer 14 is constructed of lightweight, compressible foam material (e.g., open cell polyurethane foam), preferably with a thickness between about 0.50 and 1.0 inches.

Figure 2:
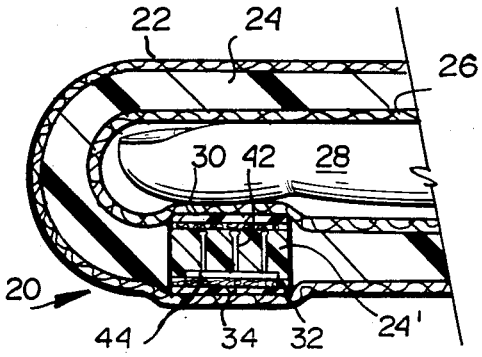
FIG. 2 is a cross-sectional view of a finger portion of a glove in accordance with this invention.
Figure 3:
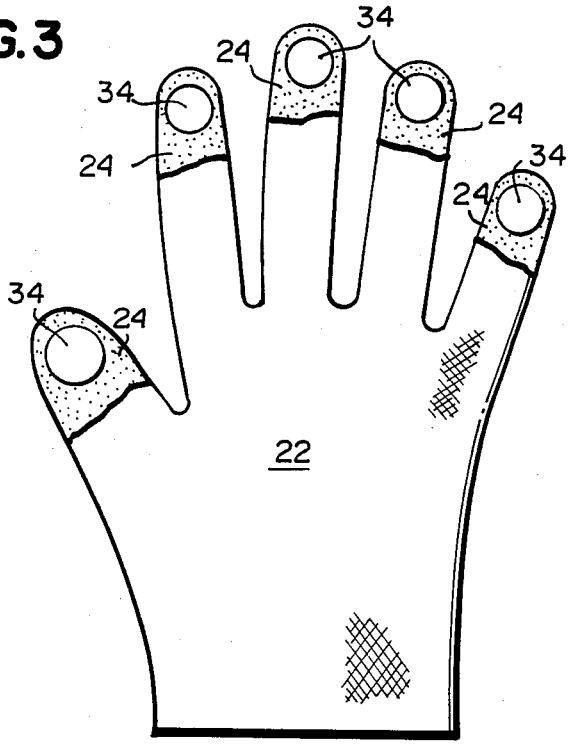
FIG. 3 is a "palms up" view of a glove in accordance with this invention, partially broken away to illustrate external response surface pads in thumb and multiple fingertip portions of the glove.

In FIGS. 2 through 5, glove and mitt constructions in accordance with this invention are shown. As in the case of the known glove construction illustrated in FIG. 1, the glove 20 shown in FIG. 2 includes a shell layer 22, an intermediate insulating layer 24 of open cell polyurethane foam or the like, and an inner lining 26. In accordance with this invention, however, the glove is also provided with additional means which provide increased tactile sensitivity to external vibration stimuli. Such means include individual contact pads 30 in at least one, and preferably all, the thumb and fingertip portions of the glove. As illustrated in FIGS. 2 and 3, contact pads 30 are located directly beneath fingertip portions opposite the fingernails, i.e., on the palm side of the hand.

The finger contact pads 30, which may be round in shape and about one half to three quarters of an inch in diameter, are constructed of material having a greater stiffness than the foam material 24 since it has been determined that the stiffer material exhibits better vibration transmission characteristics than the softer foam material. In one exemplary embodiment, the finger contact pads comprise a backing material provided on one side with Velcro TM hook and loop fastener material. The other side may be provided with any of a variety of suitable adhesives. The finger contact pads are arranged within the thumb and finger portion of the glove such that the hook and loop elements face away from the user's fingertip, with the other side of said pad adhesively secured to the external side of the inner lining 26.

Other relatively stiff materials may be utilized as finger contact pads, so long as the material has an Instron compression force greater than at least twice that of the foam insulating layer.

Directly underlying each of the finger contact pads 30, and within the insulating layer 24, there is disposed a transmission system 32 located directly beneath the finger contact pads and extending outwardly to approximately the outer surface of the insulating material 24. The tactile transmission system 32, as in the case of the finger contact pads, should be constructed of relatively stiff material so long as the material has an instron compression force greater than at least twice that of the foam insulating layer so that external vibrations are effectively transmitted to the wearer's fingertips through the finger contact pads. In this exemplary embodiment of the invention, the transmission system comprises a plurality of rigid, plastic prongs 42 embedded in the foam insulating material 24. The prongs are shown to be connected at one end by a connecting portion 44, although a number of alternative configurations may be employed. In addition, while only one set of prongs is shown in FIG. 2, it is understood that two or more sets may be utilized for effective transmission of vibrations to the wearer's fingertips.

In the manufacture of gloves or mitts according to the FIG. 2 embodiment of the invention, as well as those alternative embodiments illustrated in FIGS. 5*a*–5*d*, it is advantageous from a production standpoint to first stamp the insulating material to remove sections or plugs, preferably cylindrical in shape, to form cavities for receiving the transmission system material. In the embodiment shown in FIG. 2 the plastic prongs 42 are shown embedded in a reinserted plug 24'. The prongs may also be embedded in a similarly shaped plug of a different, and preferably stiffer foam material which is subsequently positioned within the cavity in the foam material 24.

Figure 4:
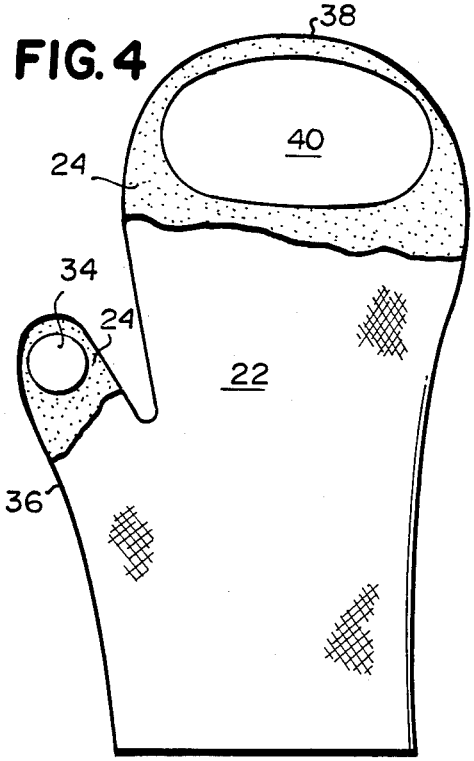
FIG. 4 is a "palms up" view of a mitt in accordance with this invention, partially broken away to illustrate external response surface pads in each of the thumb and single fingertip portion of the mitt.

The glove construction as described hereinabove may further be provided with discrete response surfaces between the transmission system material 32 and the shell layer 22. For example, as illustrated in FIGS. 2–4, discrete response surfaces 34 may be located directly beneath the transmission system material between the foam insulation 24 and the internal side of the shell layer 22. In a preferred embodiment, these response surfaces also consist of Velcro TM -type pads similar to those used for the finger contact pads 30. When used as response surfaces, the pads are arranged so that the hook and loop fastener material extends into the foam while the adhesive face is adhered to the inner surface of the shell layer. It is to be understood that the utilization of discrete response surface pads 34 is not always required. In certain environments, it may be advisable that the shell layer itself comprise the surface response means.

With regard to FIG. 4, a mitten type glove is disclosed therein where, in addition to a thumb portion 36, only one finger portion 38 is provided. In this case, the finger pad (not shown) and transmission material (not shown) in the finger portion may each be configured in the general shape of the larger response surface pad 40. The thumb portion would, of course, remain as in the glove construction illustrated in FIG. 3.

Figure 5A:
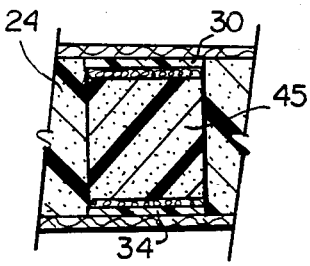
FIGS. 5*a* through 5*d* are partial cross-sectional views of the glove construction of FIG. 2 but showing alternative embodiments of the transmission system.

There is illustrated in FIG. 5A, an alternative transmission system to that shown in FIG. 2. Here, the transmission material comprises solid polystyrene in the form of a plug which fits into a cavity provided in the insulating layer 24. Polystyrene in this form proves to be an effective transmitter of vibrations and, in fact, may even amplify the vibrations to provide enhanced tactile sensitivity.

Figure 5B:
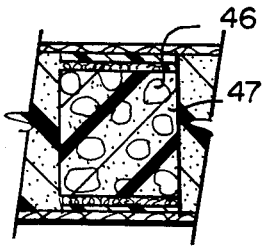

In FIG. 5*b*, an alternative transmission configuration is provided by impregnating a plug 47 of foam material with a plurality of polystyrene pellets 46. The plug 47 comprises foam material stiffer than foam in layer 24, although it is understood that it may be of the same foam material. The pellets have been found to provide even greater stiffness to the foam 47 to thereby enhance its ability to transmit external vibrations to the finger contact pad and, ultimately, to the wearer's finger.

Figure 5C:
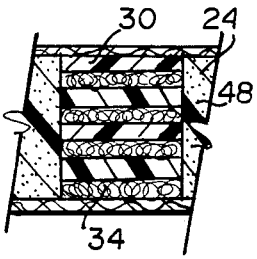

In FIG. 5*c*, still another alternative transmission arrangement is disclosed. In this embodiment, two additional Velcro TM hook and loop fastener pads 48 are stacked, one on top of the other within a generally cylindrical cavity in the foam material 24.

It is understood that the Velcro TM fastener pads may be combined with smaller foam inserts to substantially fill the cavity, if desired, or the number of such pads may be chosen so that no additional foam material is required.

Figure 5D:
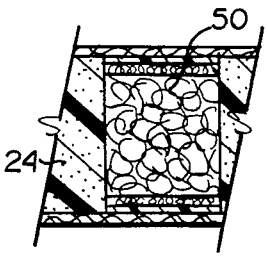

In FIG. 5*d*, a still further embodiment of a suitable transmi-ssion material is disclosed. In this instance, a cylindrical plug 50 of large open cell foam material, which is of increased stiffness as compared to insulating material 24, is inserted in a similarly shaped cavity provided in the insulation material.

It is recognized that the requirement for higher stiffness in the components utilized to increase tactile sensitivity in accordance with this invention is somewhat in conflict with the concurrent desire for overall flexibility in the glove. Nevertheless, the use of relatively small pads and transmission systems in the present invention minimizes the flexibility problem to a great extent. Moreover, the glove construction as described hereinabove is seen to be particularly advantageous in that tactile sensitivity is increased while, at the same time, the bulk necessary for good thermal characteristics is maintained.

While the present invention has been described primarily in the context of a cold weather glove of layered construction, the invention may also be advantageously utilized in any type glove construction where a relatively thick material is employed which would otherwise impair the tactile sensitivity of the user.

It is to be understood that while the invention has been described in what is presently regarded as its most practical form, various modifications will be recognized by those of ordinary skill in the art which would nevertheless remain within the spirit and scope of the invention as defined in the claims which follow.

What is claimed is:

1. A protective glove for providing a wearer with increased tactile sensitivity to external vibration stimuli, said glove constructed of relatively thick protective material and formed to provide a hand portion, at least one finger portion and a thumb portion, said glove further comprising:

discrete finger contact means provided in an interior tip portion of at least one of said finger and thumb portions of said glove; and tactile transmission means extending from said discrete contact means through said relatively thick material for transmitting external vibrations to said finger contact means and to the fingertips of the wearer at locations opposite the fingernails.

2. A protective glove as defined in claim 1 wherein said discrete finger contact means comprises a pad constructed of material of greater stiffness than said relatively thick material.

3. A protective glove as defined in claim 2 wherein said finger pad is constructed of material characterized by an Instron compression force greater than twice that of the relatively thick material.

4. A protective glove as defined in claim 3 wherein said finger pad is provided with hook and loop fastener material on one side, said pad arranged in said tip portion so that said hook and loop fastener side faces said tactile transmission means.

5. A protective glove as defined in claim 1 wherein said tactile transmission means comprises-material of greater stiffness than said relatively thick material.

6. A protective glove as defined in claim 5, wherein the tactile transmission means comprises rigid polystyrene.

7. A protective glove as defined in claim 5 wherein said tactile transmission means comprises at least one layer of hook and loop fastener material.

8. A protective glove as defined in claim 5 wherein said tactile transmission means comprises a plurality of rigid plastic prongs extending substantially perpendicularly away from said finger contact means and through said relatively thick material.

9. A protective glove as defined in claim 8 wherein said rigid plastic prongs are embedded in a removable plug of said relatively thick material.

10. A protective glove as defined in claim 5, wherein said tactile transmission means comprises open-cell foam material of greater stiffness than said relatively thick material.

11. A protective glove as defined in claim 5, wherein said tactile transmission means comprises a plurality of polystyrene pellets embedded in said relatively thick material.

12. A protective glove as defined in claim 1 wherein said glove further includes discrete response means attached to an outwardly facing surface of said relatively thick material and in generally opposed relationship to said finger contact means, and wherein said tactile transmission means extends between said contact means and said response means.

13. A protective glove as defined in claim 12 wherein said response means comprises a pad having hook and loop fastener material on one side, the pad arranged so that the hook and loop fastener side faces the tactile transmission means.

14. A protective glove as defined in claim 1, wherein said glove includes a plurality of finger portions and wherein said discrete finger contact means and said tactile transmission means are provided in each of said finger and thumb portions.

15. A protective glove as defined in claim 1, wherein said relatively thick protective material comprises polyurethane foam having a thickness between about 0.5–1.0 inches.

16. A protective, cold weather glove for providing increased tactile sensitivity to the fingertips of a wearer at locations substantially opposite the fingernails, wherein said glove includes an outer shell, a relatively thick insulating layer, and an inner liner, and wherein said glove is formed to provide at least one finger receiving portion and one thumb receiving portion, the improvement which comprises:

(a) individual finger contact means in tip portions of at least one of said finger and thumb receiving portions of said glove; and (b) individual transmission means underlying said finger contact means for transmitting external vibratory stimuli to a wearer of the glove.

17. A glove a defined in claim 16 and further comprising individual response surface means underlying each of said transmission means so that said finger contact means, transmission means and response surface means are in substantial alignment beneath the finger tips of the wearer.

18. A glove as defined in claim 17, wherein said finger contact means, said transmission means and said response surface means are provided in all of said thumb and finger portions.

19. a glove as defined in claim 17, wherein each of said individual reponse surface means comprises a pad having hook and loop fastener material on one side and adhesive on the other side, said pad arranged so that said hook and loop fastener material underlies said transmission means and said other side is adhered to an inner surface of said shell.

20. A glove as defined in claim 16 wherein each individual finger contact means comprise a pad of material stiffer than said insulating layer and inserted between the inner liner and said insulating layer.

21. A glove as defined in claim 20, wherein each of said individual finger contact means comprises a pad having hook and loop fastener material on one side and adhesive on the other, said pad arranged so that the hook and loop fastener material engages said insulating layer and said adhesive side is adhered to said inner liner.

22. A glove as defined in claim 21, wherein each of said transmission means comprises relatively stiff material which underlies said finger contact means and which lies within the thickness of said insulating layer.

23. A glove as defined in claim 22, wherein each of said transmission means includes a plurality of stiff plastic prongs embedded in said insulating material.

24. A glove as defined in claim 21, wherein each of said transmission means comprises a rigid polystyrene plug which extends through said insulating layer.

25. A glove as defined in claim 22, wherein each of said transmission means comprises at least one layer of hook and loop fastener material.

26. A glove as defined in claim 25, wherein said at least one layer of hook and loop fastener material is inserted within a cavity formed in said insulating material.

27. A glove as defined in claim 22, wherein each of said transmission means comprises open-cell foam material inserted within a cavity formed in said insulating material, said open-cell foam material having greater stiffness than said insulating material.

28. A glove as defined in claim 22, wherein each of said transmission means includes a plurality of polystyrene pellets embedded in a plug of removable insulating material.

29. A glove as defined in claim 28, wherein said pellets are embedded in a plug of insulating material stiffer than said insulating layer.

30. A glove as defined in claim 16, wherein said insulating layer comprises open cell polyurethane foam having a thickness between about 0.5–1.0 inches.

* * * * *